US005816861A

United States Patent [19]

Cheng

[11] Patent Number: 5,816,861

[45] Date of Patent: Oct. 6, 1998

[54] SYSTEM FOR USE WITH DETACHABLE HARD DISK DRIVE

[75] Inventor: Lee-Ming Cheng, Cupertino, Calif.

[73] Assignee: Hon Hai Precision Ind. Co., Ltd., Taipei Hsien, Taiwan

[21] Appl. No.: 704,441

[22] Filed: Aug. 27, 1996

Related U.S. Application Data

[63] Continuation-in-part of Ser. No. 243,146, May 17, 1994, Pat. No. 5,549,480.

[51] Int. Cl.[6] ..... H01R 27/00

[52] U.S. Cl. ..... 439/653; 439/948

[58] Field of Search ..... 439/374, 377, 439/638, 653, 928.1, 948

[56] References Cited

U.S. PATENT DOCUMENTS

| | | | |
|---|---|---|---|
| 4,850,899 | 7/1989 | Maynard | 439/638 |
| 4,941,841 | 7/1990 | Darden et al. | 439/374 |
| 5,187,643 | 2/1993 | I-Shou | 439/928.1 |
| 5,211,566 | 5/1993 | Bates et al. | 439/653 |
| 5,395,255 | 3/1995 | Kato | 439/948 |

*Primary Examiner*—Neil Abrams

[57] ABSTRACT

An interconnection system includes a hard disc drive (24) having a standard header connector (101, 30) that can be electrically connected to one type of computer housing connector (102) by use of a flat cable (104) or, alternatively, can be attached to an adapter (26) to enable the hard disc drive to be slidably inserted into a cavity (14) of a more advanced type of computer to be electrically connected to another type of computer housing connector (16), i.e., a card edge connector. The adapter (26) includes a housing (52) defining a number of passageways (58) receiving a receiving portion of a number of contacts (60) which are connected with contacts of the header connector (30) in which a portion of the housing (52) is exposed to an exterior with regard to the header connector, and a blade (54) receiving a tail portion (68) of the contacts (60) for connection with contacts of the connector (16). When the hard disc drive (24) is slidably inserted into the cavity (14) to be electrically connected to the connector (16), the hard disc drive (24) will be stopped by standoffs (15) at a position in which the distance between the card edge connector (16) and the header connector (30) is substantially the same as the exposed portion of the housing (52) of the adapter (26).

8 Claims, 5 Drawing Sheets

SYSTEM FOR USE WITH DETACHABLE HARD DISK DRIVE

This application is a continuation-in-part of application Ser. No. 08/243,146, filed May 17, 1994, U.S. Pat. No. 5,549,480.

BACKGROUND OF THE INVENTION

1. Field of The Invention

The invention relates to a system for use within a computer, and particularly to the structural arrangement of interconnection of the mother board in the computer case and the optionally attachable hard disk drive inserted into the computer case.

2. The Prior Art

The hard disk drive which functions as a memory storage device, is generally a required part for use within the computer. The traditional hard disk drive 100 as shown in FIG. 1, is generally fastened to the computer case through screw-fastening wherein the pin type first header connector 101 can be indirectly electrically connected to a second header connector 102 mounted on the mother board 103 by means of a set of flat cable 104, of which two IDC (Insulative Displacement Contact) connectors 105 are terminated at two ends for respective engagement with the corresponding first and second header connectors 101, 102.

In the recent years, the plug-and-play (i.e., slide-in) method and the corresponding optional attachable module are popularly applied to the computer field, and the hard disk drive is also effected thereby. There are at least two advantages for this configuration. First, it is easier to assemble the whole assembly when most parts can be assembled together without additional screws, rivets, or clips. Secondly, the detachable modularized parts can be easily replaced by the similar module for upgrading the whole computer set. Therefore, several computer manufacturers have made different approaches to implement this concept.

At the early stage, as shown in U.S. Pat. No. 4,941,841, an attempt is made that pin and socket connectors are respectively arranged on the removable unit and the mother board for implementation of this slide-in method. Because mating of pin-and-socket inherently results in larger insertion force which is disadvantageous to interconnection of the corresponding two connectors, and sometimes some misaligned pins tend to be damaged due to improper interference with the complementary connector and even mistakenly inserted into the wrong socket contacts of the complementary connector thereby resulting in terrible shorting event, it is not a good and reliable design from the technical viewpoint. Thus, in a later time and as shown in U.S. Pat. Nos. 5,139,439, 5,277,615 and 5,305,180, a blade type plug connector cooperates with a card edge receiving connector for achieving this plug-and-play or slide-in operation. The effect of the plug-and-play operation is deemed good and reliable.

While, there is a shortcoming of such plug-and-play design. As noted, most of such plug-and-play type hard disk drives are generally designed to have its internal PC board with an extending section which projects out of the case of the hard disk drive and has a corresponding circuit pads thereon for mating with the complementary connector (i.e., card edge connector) wherein such extending section of the PC board of the hard disk drive is designedly substantially received within the card edge connector. Also understood and mentioned before, most existing hard disk drives still use a pin header connector for connection to the mother board via a flat cable. Thus, the manufacturers of the hard disk drive will definitely hesitate to directly completely adopt the plug-and-play style, i.e., the extending section of the internal PC board design, because the plug-and-play style is not a popular or standard configuration of the hard disk drive. In other words, there are still many computer manufacturers using the conventional interconnection between the hard disk drive and the mother board, via a flat cable, of which two opposite ends respectively connect to the header connectors respectively mounted on the hard disk drive and the mother board.

Therefore, in the hard disk drive manufacturer's position, it is preferred to have his hard disk drive product be able to comply with not only the conventional type interconnection, i.e., through the flat cable, with the mother board, but also the advanced type interconnection, i.e., the plug-and-play style, with the motherboard, or at least have the preassembled PC board unit of the hard disk drive having the connector thereon, be able to incorporate the different case for corresponding to the different application situations, i.e., the conventional flat cable interconnection type or the advanced plug-and-play type. Understandably, the method of using the same connector mounted on the internal PC board of the hard disk drive adapted to be used in the two aforementioned application situations, can simplify and/or unify the manufacturing process of the hard disk drive and/or the circuit layout of the internal PC board thereof, thus saving the cost. Oppositely, for the hard disk drive, using a header connector directly mounted on the internal PC board for compliance with the conventional interconnection with the mother board and using another different plug type connector directly mounted on the internal PC board for compliance with the advanced plug-and-play interconnection situation, are substantially not economic enough and also complicate the design and quality control considerations. Therefore, the hard disk drive manufacturers intend to have, the former implemented.

Therefore, an object of the invention is to provide an interconnection system including specific structures of the hard disk drive and the corresponding mechanism on the mother board side, which can satisfy both the advanced style and traditional style interconnection under the situation that only one type connector is designedly mounted on thee internal PC board of the hard disk drive for simplifying the fabrication process and/or the circuit layout design for the hard disk drive manufacturing.

SUMMARY OF THE INVENTION

According to an aspect of the invention, an interconnection system for use within a computer having a detachable and replaceable hard disk drive, comprises a chassis defining slot for retainably receiving the hard disk drive wherein provided proximate the end of the slot is a card edge connector directly mounted on an edge section of the mother board. A header connector is provided proximate an edge section of the internal PC board of the hard disk drive wherein such hard disk drive includes a case defining an opening to expose the header connector to an exterior. The relative distance between the header connector of the hard disk drive and the card edge connector of the mother board when such hard disk drive is moved along the slot into the interior of the chassis and stopped at its final position, is designed to have a proper space remaining between these two corresponding connectors for precisely setting an transference device or an adapter therebetween as an interface device. Therefore, through such transference device the hard disk drive can be electrically connected to the card edge connector on the mother board. Alternately, the hard disk drive also can be used within a traditional type computer which uses the flat cable to connect the header connector of the hard disk drive and another header connector substantially mounted on the interior area of the mother board under the condition that the hard disk drive is generally fastened to the computer internal structure through the traditional screw-fastening method before the computer case has been assembled thereto.

DETAILED DESCRIPTION OF THE PREFERRED EMBODIMENT

Figure 1:
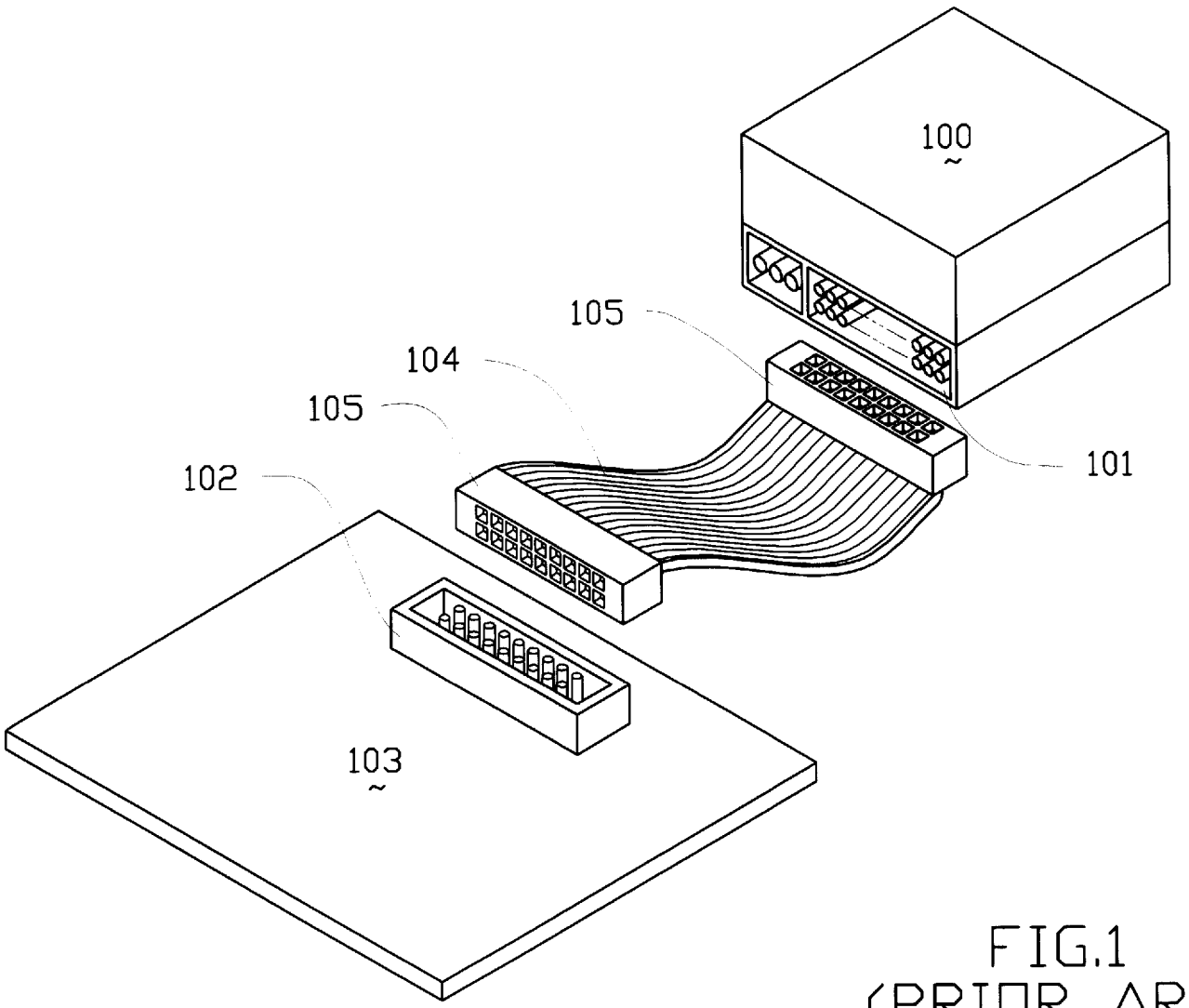
FIG.1 (PRIOR ART)
FIG. 1 is a perspective view of an interconnection system of the prior art using a flat cable connecting two header connectors respectively mounted on the hard disk drive and the mother board.
Figure 2:
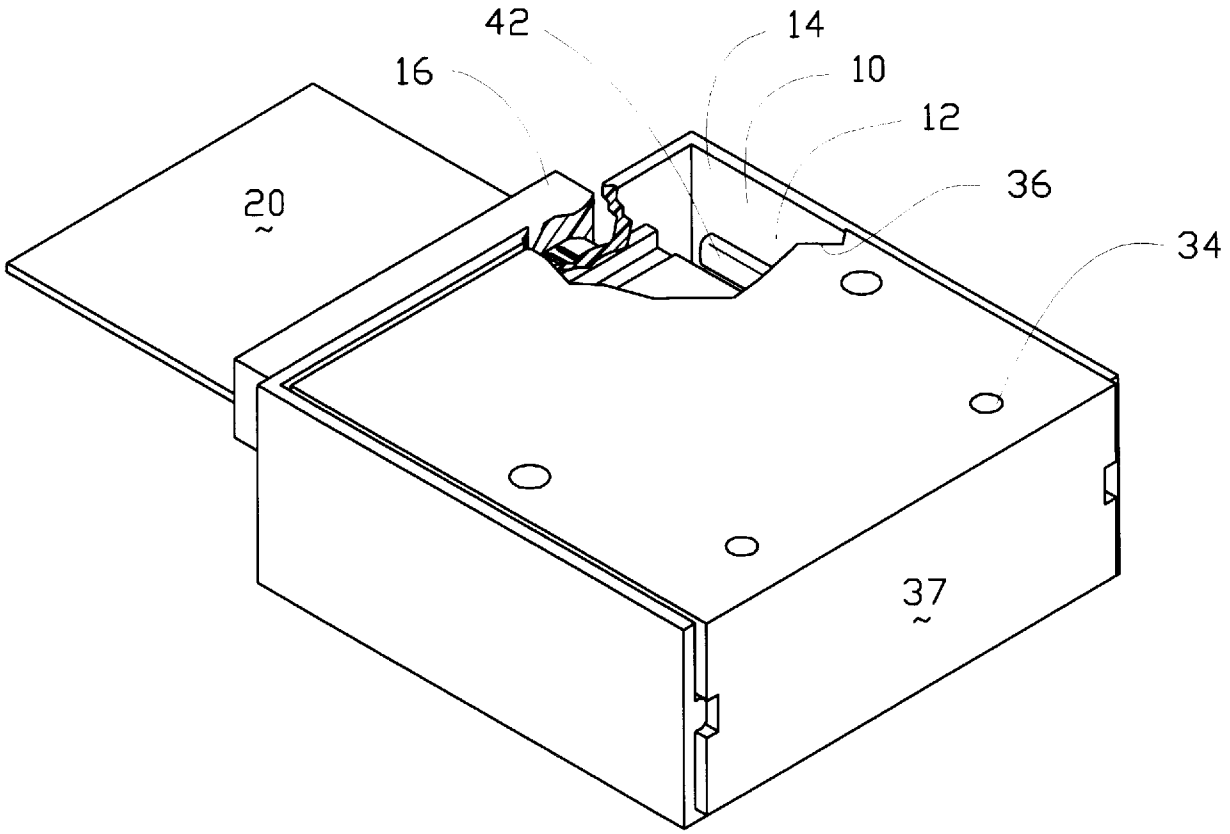
FIG. 2 is a perspective view of a presently preferred embodiment of an interconnection system for connecting a hard disk drive and the mother board within a computer according to the invention.
Figure 3:
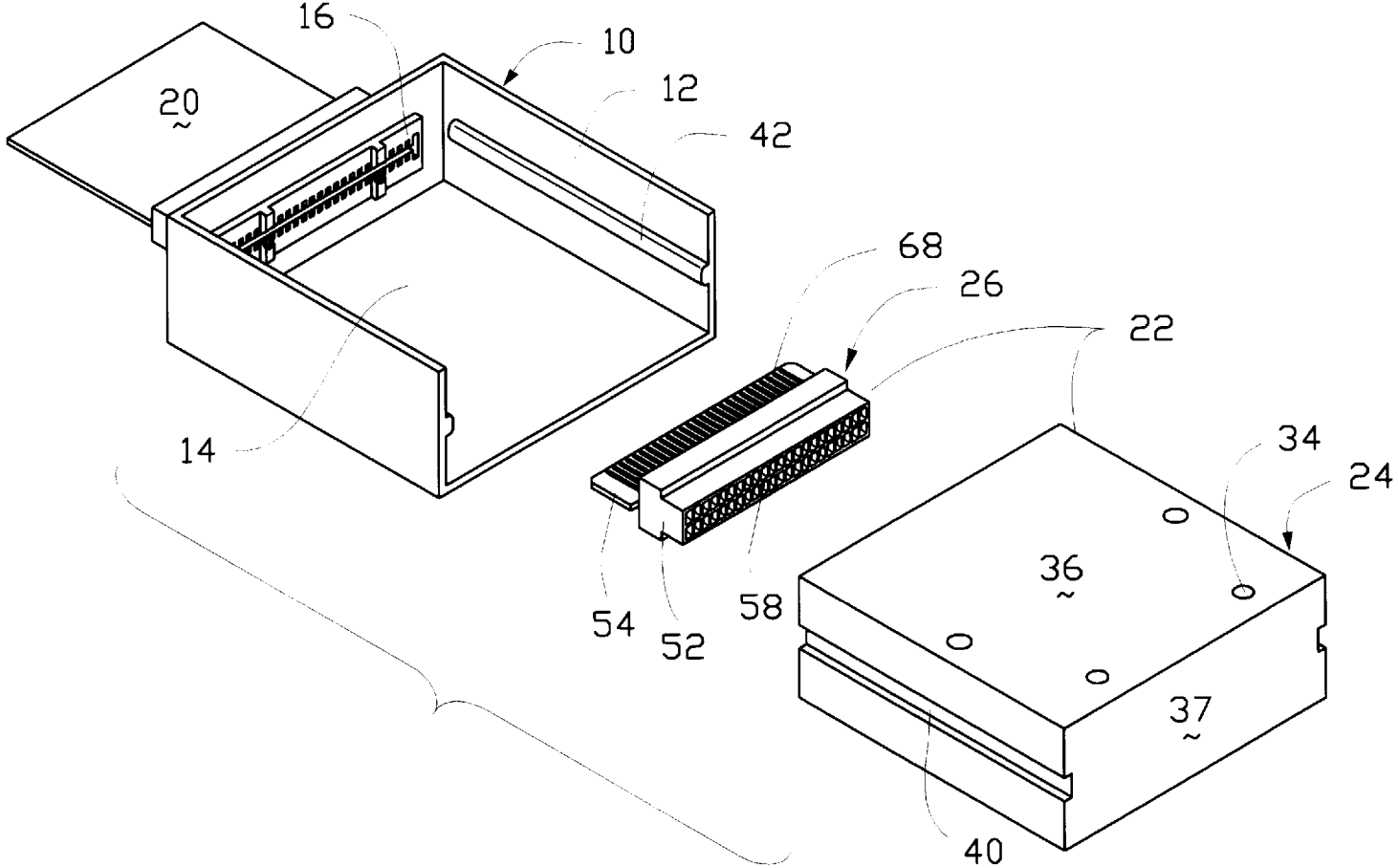
FIG. 3 is an exploded perspective view of the hard disk drive assembly of FIG. 2.

References will now be made in detail to the preferred embodiments of the invention. While the present invention has been described with reference to the specific embodiments, the description is illustrative of the invention and is not to be construed as limiting the invention. Various modifications to the present invention can be made to the preferred embodiments by those skilled in the art without departing from the true spirit and scope of the invention as defined by appended claims.

It will be noted here that for a better understanding, most of like components are designated by like reference numerals throughout the various figures in the embodiments. Attention is directed to FIGS. 2–5 wherein the a frame or chassis 10 is provided within a computer 1 (FIG. 5). The frame 10 includes a pair of side walls 12 defining a hard disk drive receiving cavity 14 therebetween. Provided proximate the distal ends of the side walls 12 is a card edge connector 16 which is directly mounted on an edge portion 18 (FIG. 5) of a mother PC board 20.

A hard disk drive assembly 22, which is adapted to be retainably received within the cavity 14 of the frame 10, includes a hard disk drive 24 and an transference device or an adapter 26 wherein the hard disk drive 24 comprises an internal PC board 28 (FIG. 5) having a traditional header connector 30 mounted on an edge portion 32 of an internal PC board 28 and adapted to be directly, in a traditional way, mate with a flat cable 104, as shown in FIG. 1, via a socket connector 105 positioned at one end thereof under a condition that another socket connector 105 is disposed at the other opposite end of the flat cable 104 and mate with a header connector 102 mounted on the mother board 103.

The hard disk drive 24 includes a case 36 generally surrounding the PC board 28 and the components mounted (not shown) thereon. The case 36 further forms an opening (not shown) for allowing the header connector 30 to be communicatively exposed to an exterior so that the socket connector 105 of the flat cable 104 as shown in FIG. 1, may be attached thereto for conductive connection.

The case 36 may include several screw holes 34 either in the vertical or the lateral directions for attachment with the traditional frame by means of screws. In this embodiment, the case further includes guidance devices 40 on its two sides for cooperation with guidance means 42 formed on the two side walls 12 of the chassis 10 so that the hard disk drive 24 can be slidably moved along the side walls 12 in a front-to-end direction alternately. To assure the insertable hard disk drive 24 to be in a substantially fixed position with regard to the chassis 10 when such hard disk drive 24 is pushed into the final deepest position in the cavity 14, there might be abutment or stop means optionally provided on the chassis 10. Also, a bump maybe optionally formed on the chassis 10 to incorporate an optional indent in the hard disk drive case 36 for properly retaining the hard disk drive 24 in its final position. Anyhow, a panel (not shown) will be attached unto the outer surface 37 of the case 36 for assuring the securement of the hard disk drive with regard to the chasis 10.

The card edge connector 16, which is generally positioned proximate the ends of the side walls 12, is designedly substantially spaced, in a designate distance D (FIG. 5), from the header connector 30 of the hard disk drive 24 when such hard disk drive 24 reaches its final fixed position with regard to the chassis 10. Such distance D is reserved for an interface device or an adapter 26 for respectively coupling to the header connector 30 on the hard disk drive 24 and the card edge connector 16 on the mother board 20.

Referring to FIG. 5, the adapter 26, which is generally similar to the connection device as disclosed in the copending parent application Ser. No. 08/243,146 filed May 17, 1994, includes a housing 52 with a blade 54 integrally extending rearward from its rear surface 56 wherein a plurality of passageways 58 extend through the housing 52 in a front-to-end direction for receiving a corresponding number of contacts 60 therein. Each contact 60 generally includes a receiving section formed by a pair of spring arms extending from a plate-shaped main body which is received within the passageway 58. Oppositely, a tail section 68 extends from the plate-shaped main body of the contact 60 in an opposite direction and is generally positioned on the blade 54 wherein the tail section 68 of the contact 60 is generally aligned, in the front-to-end direction, with the corresponding passageway 58 receiving the receiving section of the contact 60.

When the hard disk drive 24 is intended to be used within an advanced type system which uses a plug-and-play method for implementing assembling of the hard disk drive 24 to the computer wherein the chassis 10 is ready to receive the slidable hard disk drive 24 therein, the adapter 26 should have been attached to the header connector 30 of the hard disk drive 24 before the hard disk drive 24 is ready to be inserted into the chassis 10 along the side walls 12. Successively, the hard disk drive assembly 22 including the hard disk drive 24 associated with the attached adapter 26, moves along the side walls 12 by means of engagement between the guidance device 40 thereof and the guidance means 42 on the chassis 10. The rearward slidable movement of the hard disk drive assembly 22 will continue until the hard disk drive assembly 22 reaches its final fixed position and is properly retained in the chassis 10.

Figure 4:
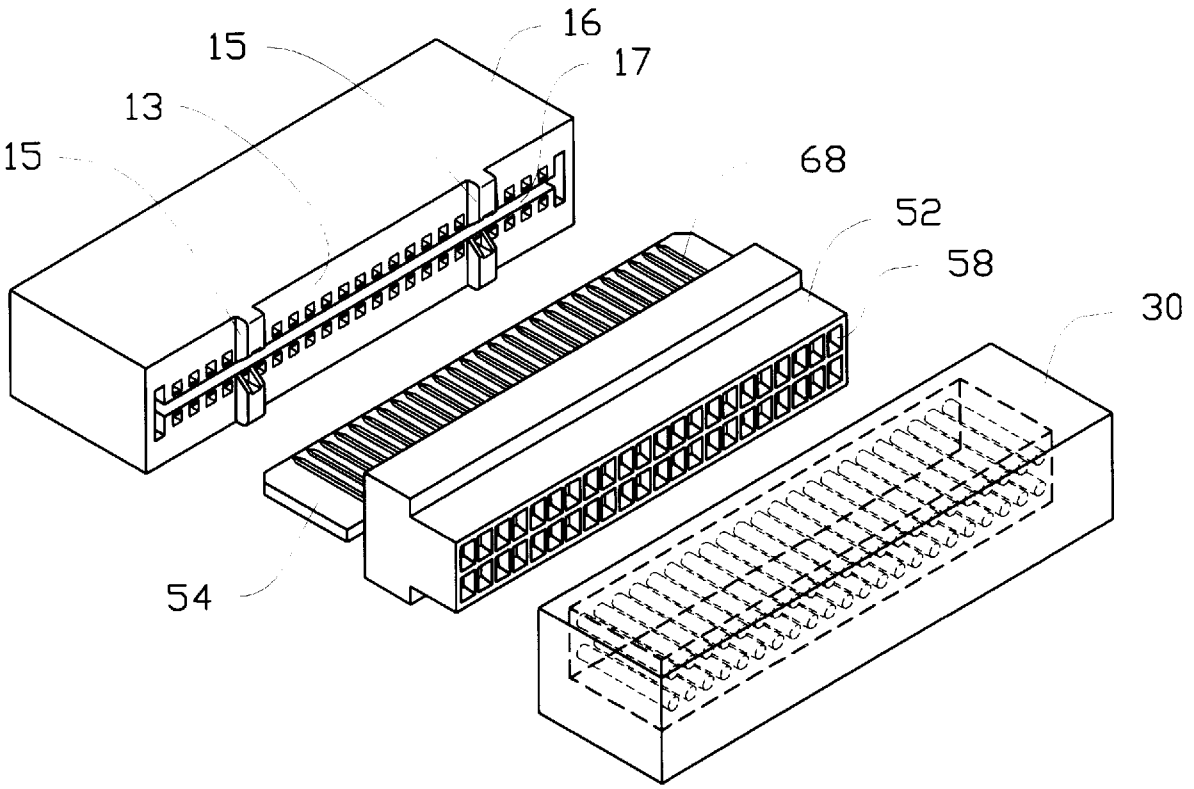
FIG. 4 is an exploded view of the portions of the header connector, adapter and the card edge connector to show the structures and mutual relationship thereamong.
Figure 5:
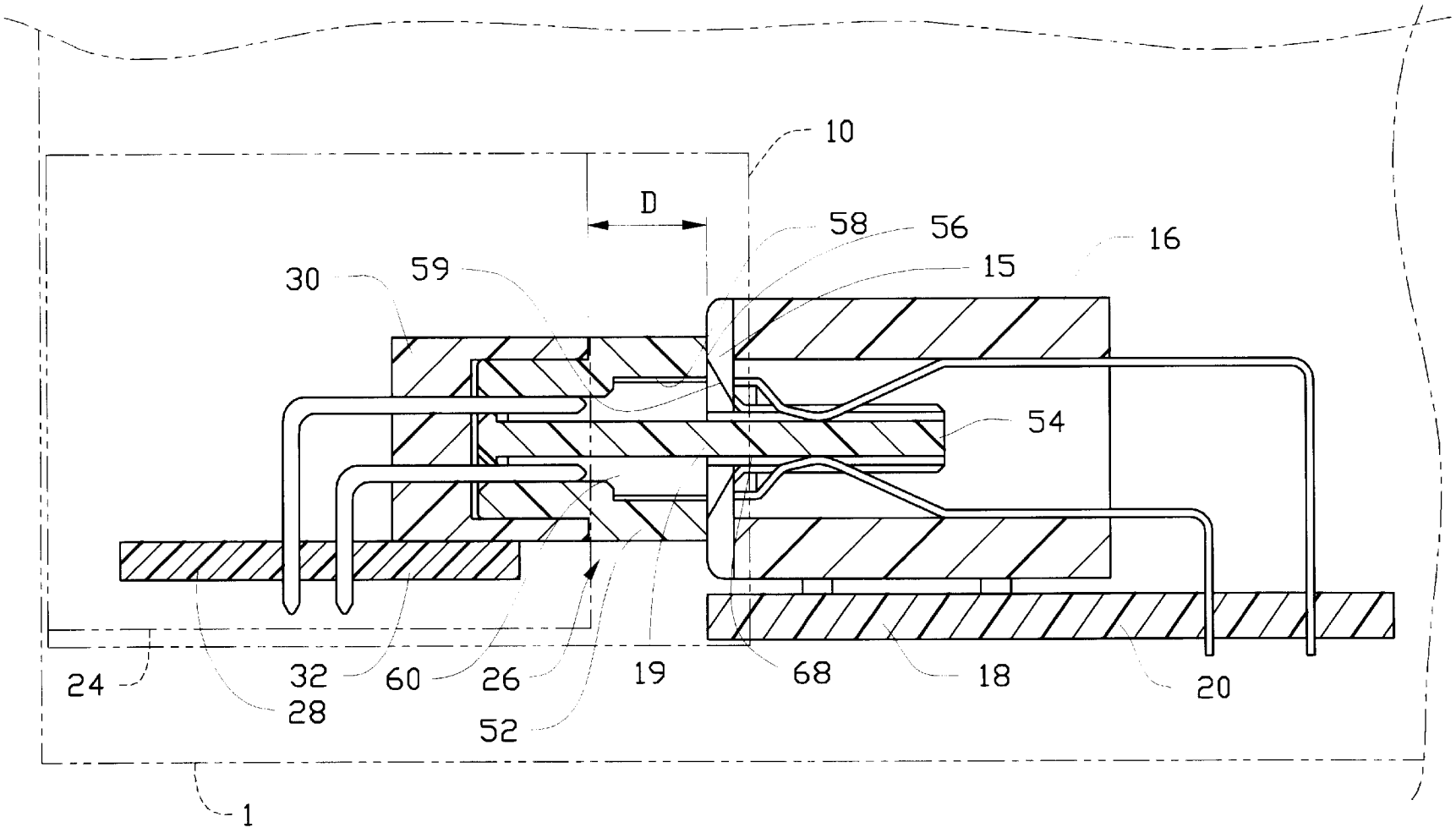
FIG. 5 is a partial cross-sectional view of the interconnection system of FIG. 2 to show the structural relationship among the header connector of the hard disk drive, the card edge connector of the mother board and the adapter positioned therebetween.

Further more, referring to FIG. 4, the dimension of the blade 54 of the adapter 26 in the front-to-end direction is also designedly arranged to be larger than that of the central receiving channel 17 of the card edge connector 16. Therefore, when the blade 54 of the adapter 26 is completely inserted into the channel 17 of the card edge connector 16, a portion 19 thereof, which is integral with the housing 52, is exposed to the exterior. In this embodiment, several sets of standoffs 15 extending forward from the front surface 13 of the card edge connector 16 and such standoffs 15 are designedly arranged to have the same dimension, in the front-to-end direction, with the exposed portion 19 of the blade 54. Thus, when the hard disk drive assembly 22 including the adapter 26 reaches its final fixed position, most portions of the blade 52 of the adapter 50 are substantially embedded with the channel 17 of the card edge connector 16, and the remaining exposed portions 19 of the blade 54 has the proper dimension in the front-to-end direction to have the ends of the standoffs 15 engaged with the rear surface 56 of the housing 52.

Therefore, the hard disk drive 24, the adapter 26 and the counterpart card edge connector 16 can be mutually reliably and assuredly electrically and mechanically assembled to each other for interconnection. It can be noted that the distance D between the header connector 30 of the hard disk drive 24 and the card edge connector 16 of the mother board 20, should be generally equal to the front-to-end dimension of the exposed portions of the housing 52. This structure provides an optimal interconnection between the hard disk drive 24 and the card edge connector 16 from mechanical and electrical viewpoints. It is also appreciated that the standoff 15 provides not only the engagement function with the rear surface 56 of the housing 52 for stabilization consideration, but also a lead-in function for the insertion of the blade 54 of the adapter 20 by means of the tapered surfaces 59 thereof (FIG. 5).

In this embodiment, the whole hard disk drive 22 including the case 36 can be used with both the conventional screw-locking manner or the advanced slide-in manner. Alternately, the case 36 may be made with two different types to respectively meet these two different applications for elimination of redundant structures of the case 36 as disclosed in the first embodiment which needs to satisfy both the two aforementioned application situations, but the internal PC board 28 having the most components including the header connector 30 may still have only one style for simplifying the manufacturing for the hard disk drive manufacturer.

It can be contemplated that using the plug-and-play arranged for the hard disk drive not only saves the assembling time for the computer manufacture, but also provides the end user with flexibility to upgrade his computer in a later time if he likes to increase the memory thereof for managing multi media matters.

While the present invention has been described with reference to specific embodiments, the description is illustrative of the invent and is not to be construed as limiting the invention. Various modifications to the present invention can be made to the preferred embodiments by those skilled in the art without departing from the true spirit and scope of the invention as defined by the appended claims.

Therefore, persons of ordinary skill in this field are to understand that all such equivalent structures are to be included within the scope of the following claims.

I claim:

1. An interconnection system used in a computer, comprising:

a mother board adapted to be fixed in the computer;

a card edge connector mounted on the mother board;

a chassis defining a receiving cavity and having an inner end proximate to the card edge connector and an outer end proximate to a shell of the computer;

a hard disc drive having a case received in the receiving cavity of the chassis, slidably connected to the chassis at a stopped position and enclosing a PC board therein;

a header connector mounted on the PC board;

an adapter having a housing detachably connected to the header connector and defining a number of contact passageways, a blade detachably connected to the card edge connector, and a number of contacts electrically connecting the header connector and the card edge connector, each of the contacts including a receiving portion received in a corresponding passageway and in connection with a corresponding contact of the header connector and a tail portion seated on the blade and in connection with a corresponding contact of the card edge connector;

wherein a portion of the blade is exposed to an exterior with regard to the card edge connector, and a portion of the housing of the adapter is exposed to an exterior with regard to the header connector, the exposed portion of the housing of the adapter having a length which is substantially the same as a distance between the card edge connector and the header connector.

2. The interconnection system as defined in claim 1, wherein said chassis includes a pair of side walls defining said receiving cavity and the card edge connector of the mother board is positioned proximate to inner ends of said side walls.

3. The interconnection system as defined in claim 1, wherein a plurality of standoffs are provided on a face of the card edge connector facing the adapter and wherein said standoffs project from the face of the card edge connector at a height which is the same as a length of the exposed portion of the blade of the adapter.

4. The interconnection system as defined in claim 3, wherein each of said standoffs includes a tapered surface for a lead-in purpose.

5. An interconnection system for connecting a hard disk drive to a mother board of a computer, comprising:

a chassis mounted in the computer and having a pair of side walls defining a receiving cavity therebetween and having inner ends in the computer and outer ends proximate to a shell of the computer;

a card edge connector directly mounted on an edge portion of the mother board in the computer and substantially positioned proximate to the inner ends of said side walls;

means for slidably engaging the hard disk drive with the chassis;

a PC board received in the hard disk drive;

a header connector mounted to an edge portion of the PC board; and an adapter including a housing adapted to be detachably connected with the header connector and defining a plurality of passageways therethrough receiving a plurality of corresponding contacts therein;

a blade integrally formed with the housing and adapted to be detachably connected with the card edge connector;

each of said contacts including a receiving section received within a corresponding passageway of the housing for engagement with a corresponding contact of the header connector, and a tail section seated on the blade for engagement with a corresponding contact of the card edge connector; whereby said hard disk drive can be slidably moved along the receiving cavity and into an interior of the chassis and stopped at a final fixed position under a condition that a distance between said card edge connector and said header connector is substantially equal to a front-to-end dimension of an exposed portion of the housing of the adapter outside the header connector.

6. The interconnection system as defined in claim 5, wherein a plurality of standoffs are formed on a front surface of the card edge connector facing the outer ends of the side walls of the chassis for engagement with the housing of the adapter.

7. The interconnection system as defined in claim 6, wherein each of said standoffs includes a tapered surface for guiding the blade of the adapter into the card edge connector.

8. An arrangement of horizontally interconnecting an adapter to a card edge connector wherein said adapter includes a housing, on a front portion, with passageways therein for reception of pins of a header connector, and a blade, on a rear portion, extending rearward integrally with the housing, said card edge connector defining a channel having a depth which is substantially smaller than a front-to-end dimension of the blade, thus having a portion of the blade exposed to an exterior when the blade of the adapter is inserted into the channel of the card edge connector, a plurality of standoffs formed on a front surface of the card edge connector and extending to engage a rear surface of the housing of the adapter on two sides of the exposed portion of the blade, wherein said standoffs further include tapered surfaces for lead-in consideration of insertion of the blade of the adapter into the channel of the card edge connector.

* * * * *